United States Patent [19]

Marchetti

[11] Patent Number: 4,643,707

[45] Date of Patent: Feb. 17, 1987

[54] TAPING UNIT POSITIONING SYSTEM FOR CARDBOARD BOX CLOSING MACHINE

[76] Inventor: Augusto Marchetti, Piazza Sicilia, 7, 20146 Milano, Italy

[21] Appl. No.: 831,436

[22] Filed: Feb. 20, 1986

[30] Foreign Application Priority Data

Feb. 22, 1985 [IT] Italy ..... 20889/85[U]

[51] Int. Cl.[4] ..... B31B 1/72

[52] U.S. Cl. ..... 493/117; 53/137; 156/468; 248/676

[58] Field of Search ..... 493/116, 117; 53/137, 53/590; 156/468, 475; 248/676; 403/315, 316

[56] References Cited

U.S. PATENT DOCUMENTS 3,800,679 4/1979 Bartelheimer ..... 493/117

4,326,694 4/1982 Destree ..... 248/676

4,531,701 7/1985 Trev ..... 248/676

*Primary Examiner*—Francis S. Husar

*Assistant Examiner*—Robert Showalter

*Attorney, Agent, or Firm*—Cushman, Darby & Cushman

[57] ABSTRACT

The taping unit has two positioning pins protruding outward from opposed sides of the taping unit. The head structure of the machine has supporting arms having longitudinal guides to accommodate and allow to slide said positioning pins of the top taping unit. Locking pins associated with said arms engage with the pins to allow stopping and locking the top taping unit. A housing recess for the bottom taping unit is provided in the box supporting base and has a pair of side shoulders containing pairs of recessed seats opening upward in which are accommodated the positioning pins of the bottom taping unit.

3 Claims, 9 Drawing Figures

TAPING UNIT POSITIONING SYSTEM FOR CARDBOARD BOX CLOSING MACHINE

The present invention relates to a taping unit positioning system for cardboard box closing machine.

Known cardboard box closing machines usually have a supporting base for the boxes and a raised head structure with supporting arms for a top taping unit.

In the supporting base there is also usually a housing recess for the lower taping unit.

The top taping unit is assembled in a known manner with horizontal screws which traverse said supporting arms and then engage with the side panel of the taping unit to consolidate it longitudinally and transversally with the head structure.

The bottom taping unit is assembled by different means which make use of the presence of pairs of recessed seats in side shoulders which delimit said housing recess in the supporting base of the machine.

The principal object of the present invention is to accomplish a new system of positioning the taping unit in the head structure of a cardboard box closing machine.

Another object of the present invention is to accomplish a taping unit positioning system which would allow the use of said taping unit both as the top taping unit and the bottom taping unit.

In view of said objects the positioning system in accordance with the invention is characterized in that the taping unit comprises two positioning pins protruding inward from opposing sides of the taping unit and the supporting arms of the machine head structure are fitted with longitudinal guides designed to receive and allow to slide said taping unit pins for the sliding insertion of said unit in said head structure, there being associated with said arms locking pins which engage with said taping unit pins to stop and hold said unit longitudinally.

It is also provided that the two pairs of taping unit positioning pins be positioned in such a manner as to be received in said pair of recessed seats when said taping unit is inserted in the housing provided in the machine support base.

In this manner is accomplished an extremely simple and effective system which has the very important benefit of making the same taping unit usable without modification both as the top taping unit and as the bottom taping unit.

Figure 1:
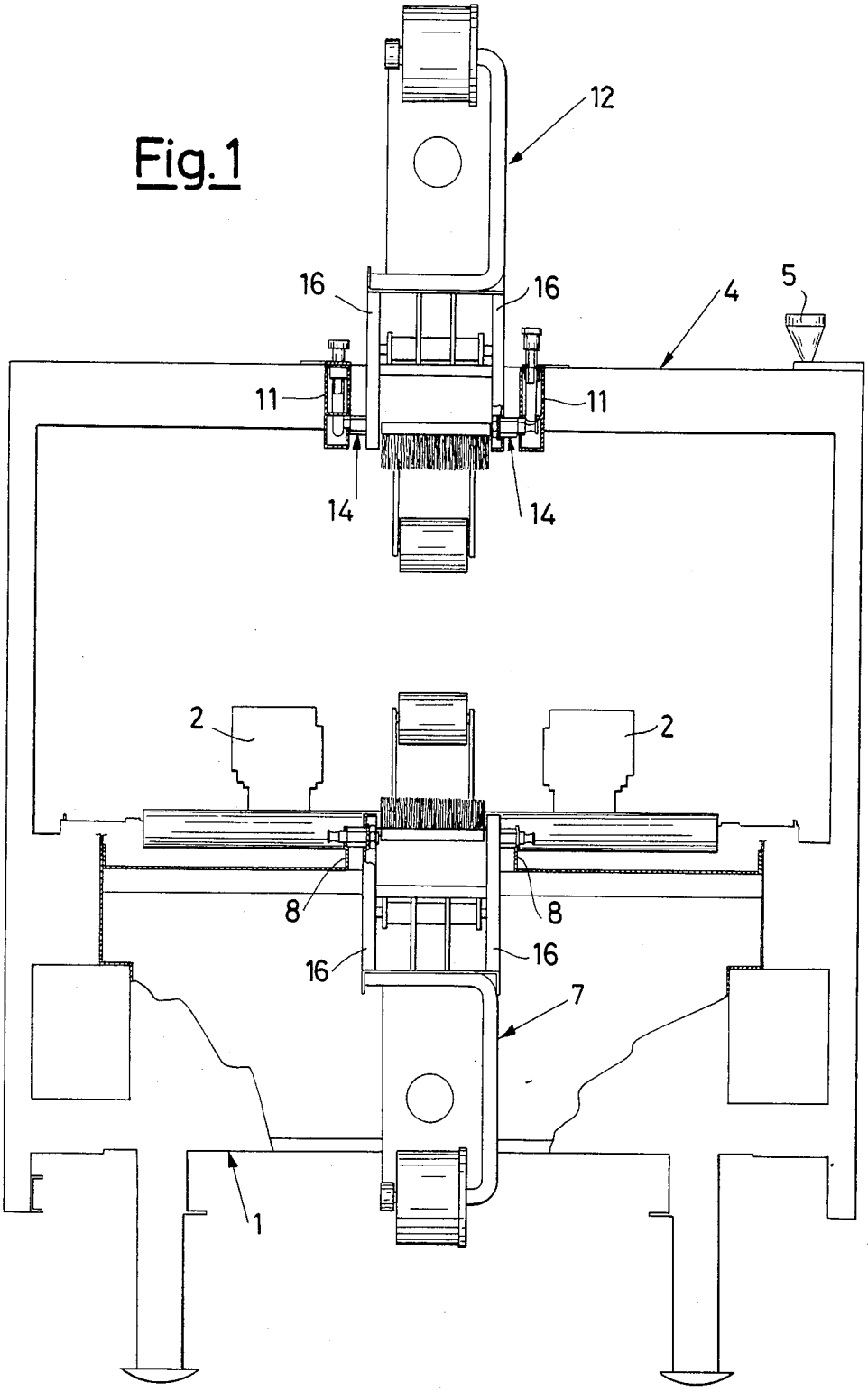
Figure 2:
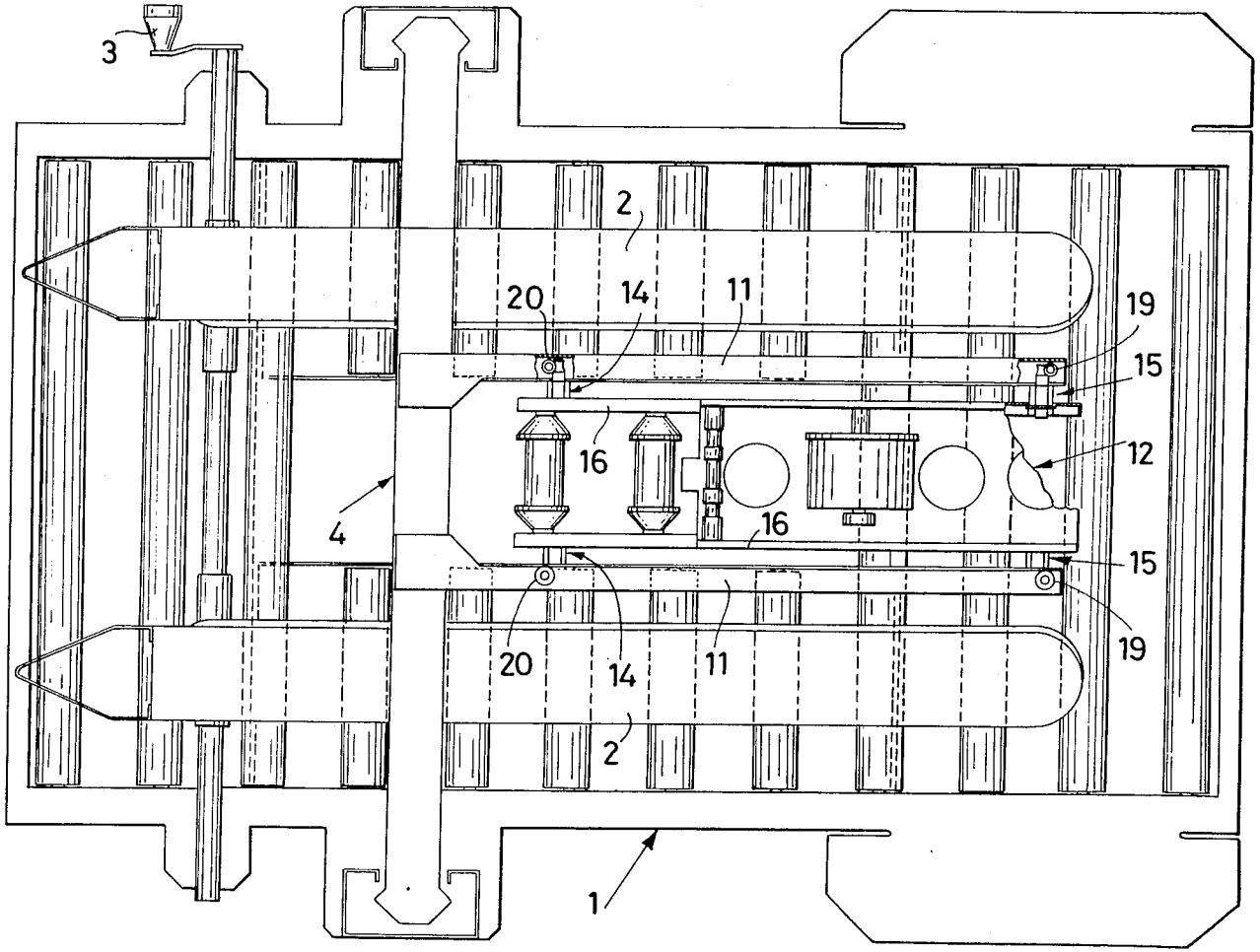
Figure 3:
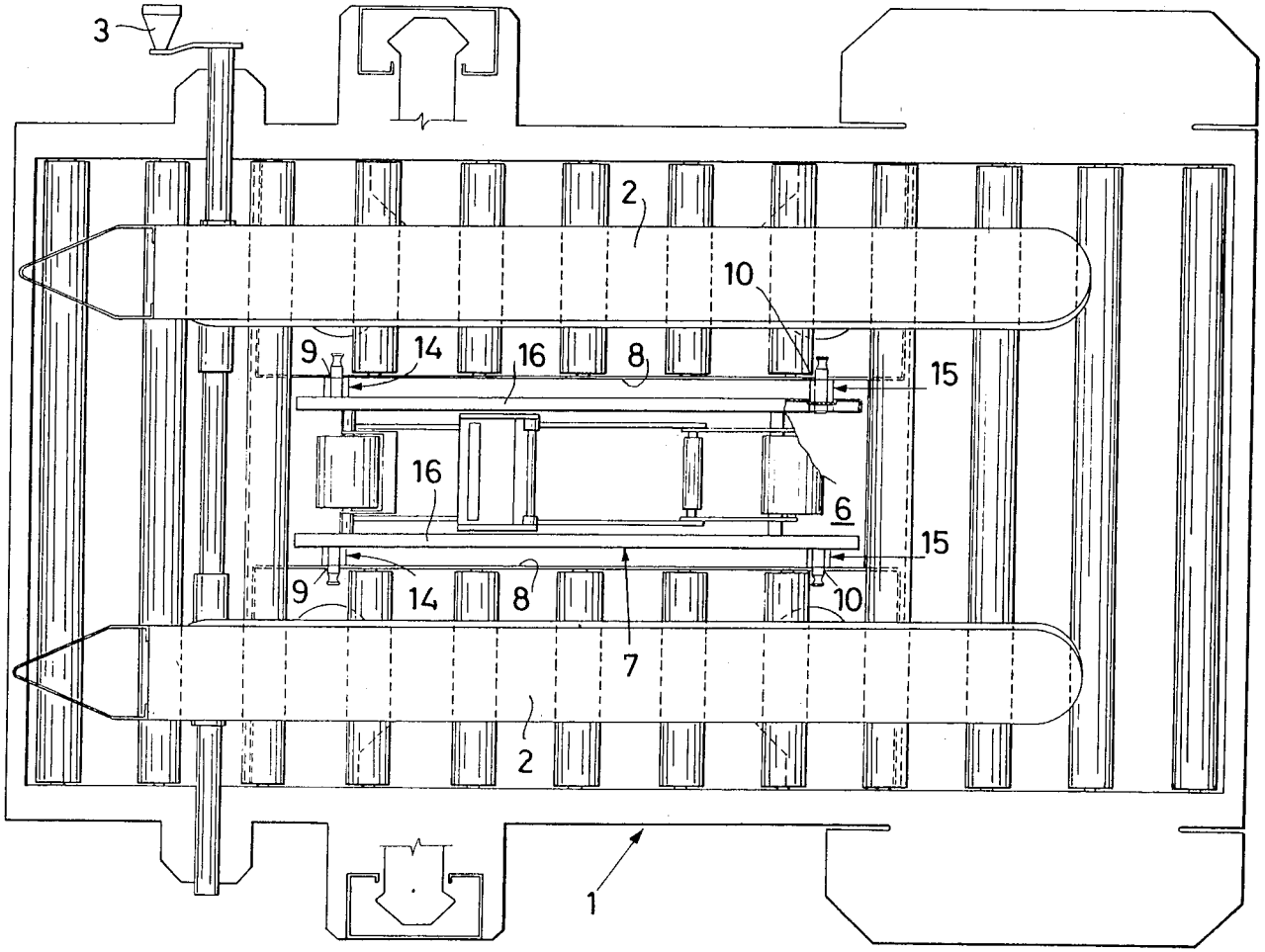
Figure 4:
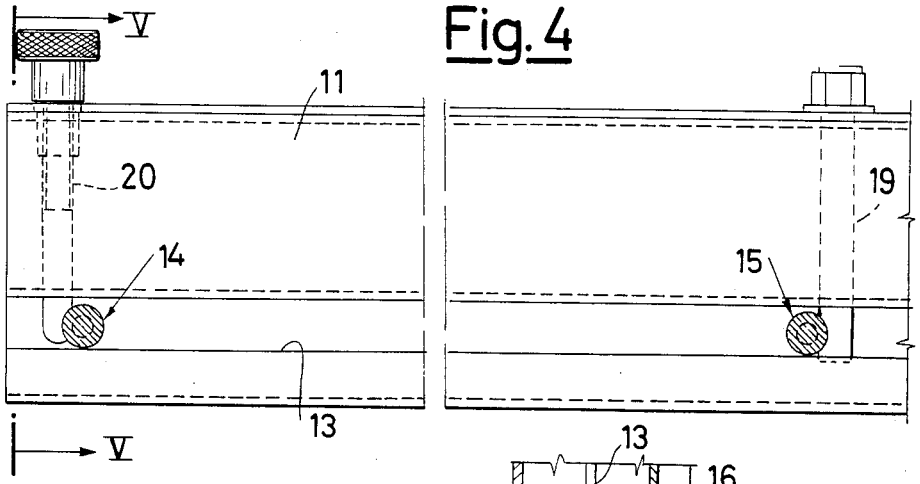
Figure 5:
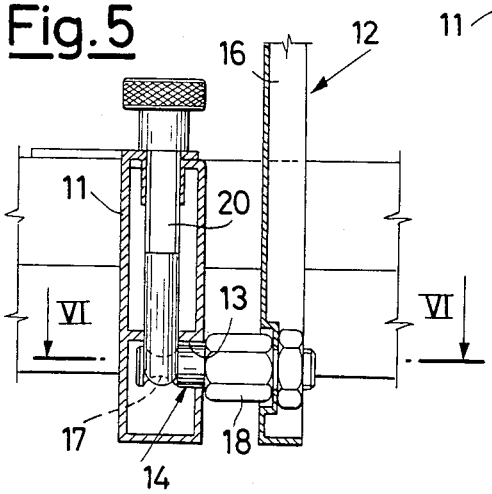
Figure 6:
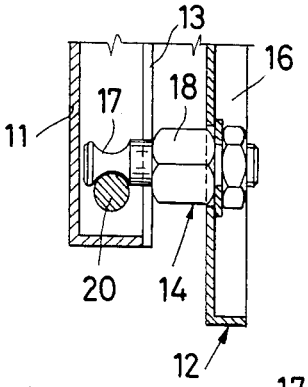
Figure 8:
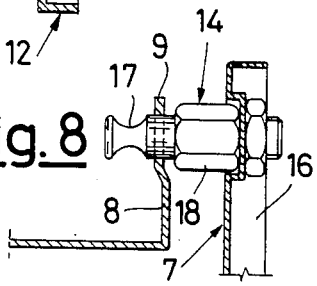
Figure 7:
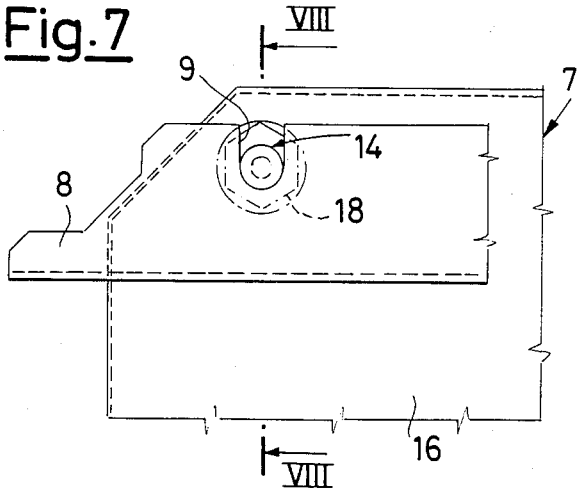
Figure 9:
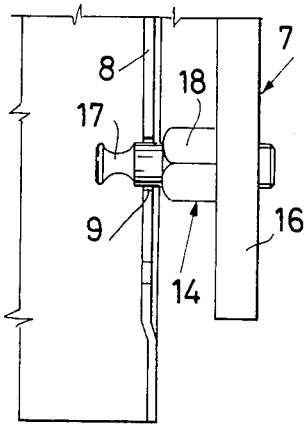

The characteristics and advantages of the present invention will be better understood from the following detailed description of a practical embodiment thereof illustrated as an example in the annexed drawings wherein:

FIG. 1 illustrates the use of a positioning system in accordance with the invention in a cardboard box closing machine, FIG. 2 shows a top view of said closing machine, FIG. 3 shows a top view of said closing machine without the head structure, FIG. 4 shows an enlarged side view of a detail of the top taping unit positioning system, FIG. 5 shows a cross section along line V—V of FIG. 4 of said detail, FIG. 6 shows a cross section along line VI—VI of FIG. 5 of said detail, FIG. 7 shows an enlarged longitudinal view of the detail of the bottom taping unit positioning system, FIG. 8 shows a cross section along line VIII—VIII of FIG. 7 of said detail, and FIG. 9 shows a top view in relation to FIG. 8 of said detail.

The drawings show schematically a cardboard box closing machine which comprises a supporting base 1 for the boxes to be closed, a pair of belt pulling-units 2 which may be arranged at a distance from each other adjustable by means of a crank 3 and a raised head structure 4 which may be arranged at an adjustable height by means of a crank 5.

In the supporting base 1 there is a housing recess 6 for a bottom taping unit 7 designed for taping the bottom of the boxes. To support the taping unit there are provided two longitudinal shoulders 8 provided with two pairs of recessed seats 9 and 10 which open upward.

The head structure 4 includes a pair of longitudinal arms 11 which are used to support a top taping unit 12 designed for taping the tops of the boxes. Said supporting arms are shaped as illustrated in FIGS. 4–6, i.e. in boxed form with longitudinal slots 13.

The two taping units 7 and 12 are identical and have positioning means which make them usable either as top taping units or as bottom taping units.

Said positioning means consist of two pairs of positioning pins 14 and 15, which protrude outward from the side panels 16 of the taping unit substantially at the two ends of said unit. As shown in FIGS. 5–9 each of said pins has an anular recess 17 near its free end and an enlarged locking nut 18 butted against the side panel of the taping unit.

To use the taping unit as a top taping unit 12 the two pairs of positioning pins 14 and 15 are inserted and made to slide in the longitudinal slots 13 of the supporting arms 11 until they cause the pins 15 to butt against the vertical stop pins 19 which are screwed into the supporting arms 11 (FIG. 4). Other locking pins 20, previously in raised position as shown for the right arm in FIG. 1, are then screwed down securely to engage in the anular cavities 17 of the pins 14 to longitudinally and transversally lock the taping unit as shown in FIGS. 4–6.

To use said unit as the bottom taping unit 7 the two pairs of positioning pins 14 and 15 are accomodated in the recessed seats 9 and 10 of said longitudinal supporting shoulders 8 of the supporting base 1 as shown in FIGS. 7–9.

I claim:

1. Taping unit positioning system for cardboard box closing machine of the type having a supporting base for the boxes and a raised head structure with supporting arms for the top taping unit characterized in that the taping unit comprises a pair of positioning pins protruding outward from opposite sides of the taping unit and said supporting arms have longitudinal guides designed to accomodate and allow to slide said pins of the taping unit for the sliding insertion of said unit in said head structure, there being associated with said arms locking pins which engage with said pins of the taping unit to stop and lock longitudinally said unit.

2. Positioning system in accordance with claim 1 characterized in that said positioning pins have anular recesses in which are butted perpendicularly said locking pins to lock the taping unit longitudinally and transversally.

3. Positioning system in accordance with claim 1 for a taping unit for a closing machine with supporting base having a housing recess for a bottom taping unit, said housing recess being delimited by a pair of side shoulders having pairs of recessed seats opening upward, characterized in that said pairs of positioning pins of the taping unit are positioned in such a manner as to be accomodated in said pairs of recessed seats when said taping unit is inserted in said housing recess.

* * * * *